US005540154A

United States Patent [19]

Wilcox et al.

[11] Patent Number: 5,540,154

[45] Date of Patent: Jul. 30, 1996

[54] NON-PYROLIZING LINEAR IGNITION FUSE

[75] Inventors: Robert M. Wilcox, Fairfield; Raymond A. Drake, Vacaville, both of Calif.

[73] Assignee: OEA Aerospace, Inc., Fairfield, Calif.

[21] Appl. No.: 465,900

[22] Filed: Jun. 6, 1995

[51] Int. Cl.[6] ..... C06C 5/00

[52] U.S. Cl. ..... 102/275.1; 102/275.11

[58] Field of Search ..... 102/275.1, 275.6, 102/275.8, 275.11, 275.9

[56] References Cited

U.S. PATENT DOCUMENTS

| | | | |
|---|---|---|---|
| 1,539,018 | 5/1925 | Mott et al. | 102/275.8 |
| 2,239,052 | 4/1941 | Pearsall et al. . | |
| 3,320,882 | 5/1967 | Schulz . | |
| 3,731,626 | 5/1973 | Grayson | 102/275.8 |
| 4,178,853 | 12/1979 | Garrison et al. | 102/275.1 |
| 4,220,087 | 9/1980 | Posson . | |
| 4,312,272 | 1/1982 | Baker et al. | 102/275.8 |

FOREIGN PATENT DOCUMENTS

| | | | |
|---|---|---|---|
| 3020957 | 12/1981 | Germany | 102/275.1 |
| 652542 | 4/1951 | United Kingdom | 102/275.1 |
| 728240 | 4/1955 | United Kingdom | 102/275.1 |

*Primary Examiner*—Stephen M. Johnson

*Attorney, Agent, or Firm*—Flehr, Hohbach, Test, Albritton & Herbert

[57] ABSTRACT

Linear ignition fuse having an elongated core of non-detonating ignitive material, a longitudinally extending gas channel adjacent to the core for supporting an ignitive reaction which travels along the fuse, a frangible sheath of inorganic material surrounding the core and the channel, and a jacket of braided filaments encasing the sheath.

14 Claims, 1 Drawing Sheet

NON-PYROLIZING LINEAR IGNITION FUSE

This invention pertains generally to ignition fuses and, more particularly, to a non-detonative linear ignition fuse suitable for use in gas generators and other applications requiring substantially instantaneous ignition of a material distributed along the exterior length of the fuse.

Linear ignition fuses have heretofore been used in a broad range of applications. U.S. Pat. No. 2,239,052, for example, discloses a fuse which is used as a trunk-line for prompt, programmed ignition of multiple time delay fuses, typically employed in explosive blasting operations. U.S. Pat. No. 3,320,882 discloses an ignition cord having a mixture of high explosive and particulate fuel in a ductile metallic sheath for use in the ignition of rocket propellant grains. U.S. Pat. No. 4,220,087 discloses a linear ignitor fuse having a core of non-detonating, ignitive material encased within a frangible sheath of plastic, metal, ceramic or a composite material such as a synthetic resin containing high strength fibers.

Linear ignition fuses have also been used in a wide variety of additional applications such as the ignition of gun propellant charges, smoke bombs, inflators, ejectors and similar applications where the principal concerns are a high propagation rate and a high heat output for rapid ignition of an adjacent material.

One problem which has not been addressed adequately with such fuses is the safety hazard posed by the products of reaction during ignition and the flammability of gases produced by pyrolization of unburned residue from the fuses. In many applications, the fuses have not been initiated in proximity to humans, and the safety hazard has not been of particularly great concern.

However, in more recent applications, the products of reaction have become more important.

In the past few years, for example, linear ignition fuses have found wide application in airbag inflators for automobiles. In that application, the fuse is initiated upon a collision impact, then ignites a propellant inside a gas generator or pressure vessel to produce a gas which inflates the airbag. In the latter stage of inflation, after the propellant within the inflator has been largely exhausted, any residual and unburned organic materials within the hot inflator (e.g., unburned plastic sheathing from the ignition fuse) pyrolizes and generates flammable gasses which are vented into the airbag, posing a fire hazard to occupants of the vehicle.

In addition, after a brief period of inflation, the airbag is deflated by venting its contents into the passenger compartment. Occupants of the vehicle are thus subjected to the products of combustion and the subsequent emission of flammable gasses resulting from pyrolized organic residue within the inflator.

It is in general an object of the invention to provide a new and improved linear ignition fuse.

Another object of the invention is to provide a linear ignition fuse of the above character which will not produce pyrolizable residue subsequent to ignition.

Another object of the invention is to provide a linear ignition fuse of the above character which produces minimal toxic gasses.

Another object of the invention is to provide a linear ignition fuse of the above character which has a superior ignition capability at very low temperatures.

Another object of the invention is to provide a linear ignition fuse of the above character which is chemically stable and functionally consistent, repeatable and reliable.

Another object of the invention is to provide a linear ignition fuse of the above character which can be produced economically.

These and other objects are achieved in accordance with the invention by providing a linear ignition fuse having an elongated core of non-detonating ignitive material, a longitudinally extending gas channel adjacent to the core for supporting an ignitive reaction which travels along the fuse, a sheath of inorganic material surrounding the core and the channel, and a jacket of braided filaments encasing the sheath.

Figure 1:
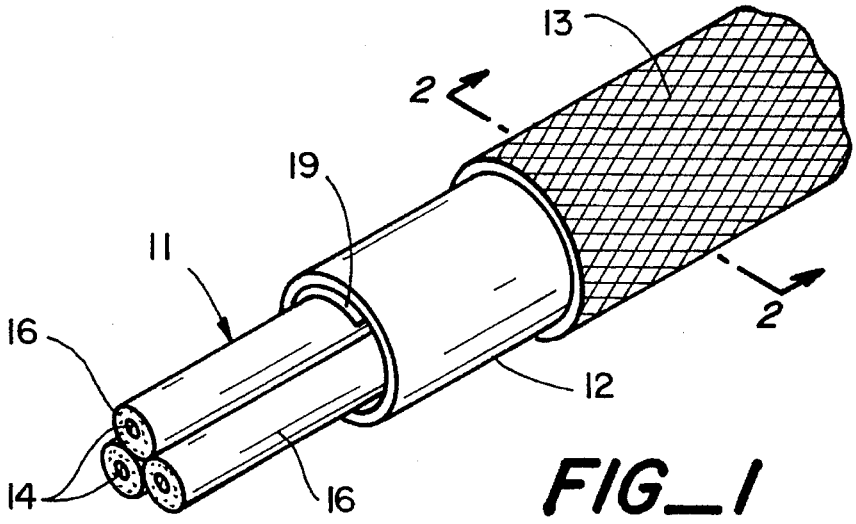
FIG. 1 is a fragmentary isometric view, partly broken away, of one embodiment of a linear ignition fuse according to the invention.
Figure 2:
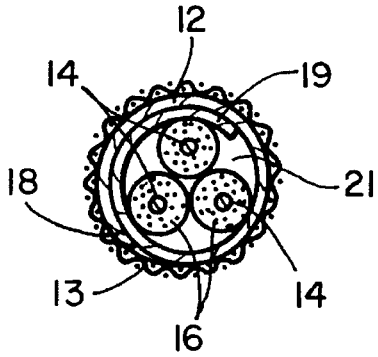
FIG. 2 is a cross-sectional view taken along line 2—2 in FIG. 1.

As illustrated in FIG. 1, the fuse includes an elongated core 11 encased within a frangible sheath 12 and a braided jacket 13. The core comprises three strands 14 which are coated with a non-detonating, ignitive mixture 16 of powdered inorganic fuel, inorganic oxidant and a suitable binder.

The strands are fabricated of an inorganic material such as glass, metal, carbon or ultra high density polyethylene fibers.

The fuel is also inorganic and has a high heat of combustion, preferably greater than 2,000 calories per gram. Suitable powdered fuels include aluminum, titanium, magnesium, a 50/50 aluminum-magnesium alloy, amorphous boron, a 70/30 zirconium-nickel alloy, or calcium silicide.

Suitable inorganic oxidants include potassium perchlorate, ammonium perchlorate, and a wide variety of nitrates, chromates, polychromates, or perchlorates of alkali or alkaline rare earth metals, or ammonia.

The binder is a polymeric material which is chemically compatible with the fuel and oxidant, has good adhesive qualities even in extremely small concentrations, has low gas evolution when cornbusted, will not leave pyrolizable residue when burned, has good mechanical strength, and is stable in storage for extended periods of time.

Sheath 12 is fabricated of an inorganic material which does not produce flammable gasses or toxic emissions when burned. In the embodiment of FIG. 1, the sheath consists of a ribbon or strip of metallic foil which extends longitudinally of the fuse and is wrapped circumferentially about the core, with edge portions 18, 19 of the strip overlapping each other by approximately 90° to 180°, i.e. one-quarter to one-half of the circumference of the sheath. The sheath thus fully encloses the core with no gaps in it. Other suitable materials for the sheath include ceramics and glass.

Jacket 13 is likewise fabricated of an inorganic material such as metallic wire or yarn which does not produce flammable gasses or toxic emissions when burned.

The spaces between the strands form gas channels 21 which extend longitudinally of the fuse adjacent to the core for supporting an ignitive reaction which travels along the fuse.

In a preferred method of manufacture, fiberglass strands are coated with a mixture of powdered fuel, oxidant, modifiers and binder in an extrusion process. The mixture is allowed to dry, and three of the coated strands are fed into a machine which wraps a sheath of thin metal foil around them. The wrapped strands are then fed into a braiding machine which braids a layer of inorganic filaments, such as aluminum or stainless steel wire over the exterior surface of the sheath.

EXAMPLE

A compound consisting of approximately 39% potassium perchlorate, 34% ammonium perchlorate, 21% fine flake aluminum powder, 3% diatomaceous earth, and 3% Hycar 4001 polyethylacrylate binder was blended using acetone as a mixing solvent. The compound was mixed continuously until all of the ingredients were thoroughly blended, and the mixture reached the consistency of a heavy paste. The paste was then deareated and pressure-extruded onto strands of glass fiber having a tare weight of approximately 80 milligrams per meter. From the extruder, the coated strands were passed through a hot air drying oven to drive off any remaining acetone solvent, then coiled onto take-up reels. The weight of the coated strand was approximately 1,500 milligrams per meter.

Three reels of the strand were ganged together, side-by-side, and the three strands were fed into a two stage processing machine. In the first stage, the three strands were wrapped with an aluminum ribbon which had a thickness of 3 mils and a width of 0.580 inch. The aluminum ribbon was wrapped circumferentially about the strands, with the edge portions of the ribbon overlapping each other by approximately 90° to 180°.

In the second stage of the machine, a 24 bobbin wire braider applied an exterior jacket of braided stainless steel wire to the aluminum foil sheath. The braiding was tight and covered substantially 100% of the sheath. The outer diameter of the jacket was 0.150 inch, and the core load was on the order of 4,500 milligrams per meter.

When installed and tested in a typical solid propellant passenger-side airbag inflator, fuses prepared in accordance with the foregoing example met the necessary ignition performance requirements and did not generate any detectable products of pyrolization. Such fuses generally possess all of the desirable qualities of the fuse described in U.S. Pat. No. 4,220,087, without the undesirable effects of pyrolization produced by that device.

Figure 3:
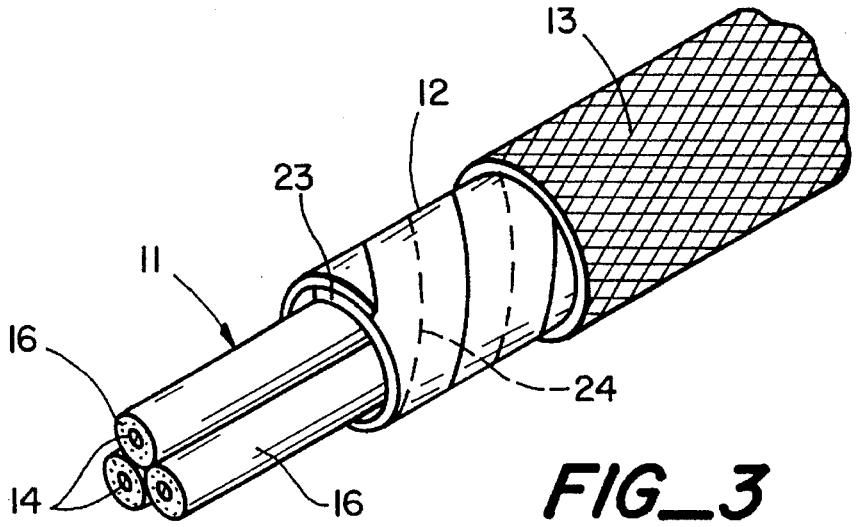
FIG. 3 is a fragmentary isometric view, partly broken away, of another embodiment of a linear ignition fuse according to the invention.

The embodiment of FIG. 3 is generally similar to the embodiment of FIG. 1, and like reference numerals designate corresponding elements in the two embodiments. The embodiment of FIG. 3 differs from the other embodiment in that the ribbon or strip 23 of metallic foil which forms the sheath 12 is wrapped helically about the core instead of circumferentially. The edge portions 24 of adjacent windings of the strip overlap each other by a distance on the order of one-quarter to one-half of the circumference of the sheath so that the core is fully enclosed by the sheath with no gaps between the windings.

In certain applications, pyrolization is not a problem, but it is still important that the fuse not leave any residue when initiated. For those applications, the braided jacket 13 which surrounds the sheath can be fabricated of an organic material, but the sheath still comprises a metallic foil which completely encloses the core.

It is apparent from the foregoing that a new and improved linear ignition fuse has been provided. While only certain presently preferred embodiments have been described in detail, as will be apparent to those familiar with the art, certain changes and modifications can be made without departing from the scope of the invention as defined by the following claims.

We claim:

1. A linear ignition fuse, comprising an elongated core of non-detonating ignitive material, a longitudinally extending gas channel adjacent to the core for supporting an ignitive reaction which travels along the fuse, a sheath of inorganic material fully enclosing the core and the channel to prevent the escape of gasses therefrom, and a jacket of braided filaments encasing the sheath.

2. The fuse of claim 1 wherein the sheath comprises a layer of metal foil.

3. The fuse of claim I wherein the sheath comprises a strip of metal foil which extends longitudinally of the fuse and is wrapped circumferentially about the core with edge portions of the strip overlapping each other by a distance on the order of one-quarter to one-half of the circumference of the sheath.

4. The fuse of claim 1 wherein the sheath comprises a strip of metal foil which is wrapped helically about the coil with edge portions of adjacent windings in the sheath overlapping each other to fully enclose the core with no gaps between the windings.

5. The fuse of claim 1 wherein the sheath is fabricated of aluminum foil.

6. The fuse of claim 1 wherein the braided filaments in the jacket are an inorganic material.

7. The fuse of claim 1 wherein the braided filaments in the jacket are metal wires.

8. The fuse of claim 1 wherein the braided filaments in the jacket are an organic material.

9. The fuse of claim 1 wherein the filaments are braided tightly together to provide substantially 100 percent coverage over the sheath.

10. A linear ignition fuse, comprising an elongated core of approximately 39% potassium perchlorate, 34% ammonium perchlorate, 21% fine flake aluminum powder, 3% diatomaceous earth, and 3% polyethylacrylate binder, a longitudinally extending gas channel adjacent to the core for supporting an ignitive reaction which travels along the fuse, a sheath of inorganic material surrounding the core and the channel, and a jacket of braided filaments encasing the sheath.

11. A linear ignition fuse, comprising an elongated core of non-detonating ignitive material, a longitudinally extending strip of metal foil wrapped circumferentially about the core to form a sheath, a longitudinally extending gas channel adjacent to the core for supporting an ignitive reaction which travels along the fuse, and a braided jacket of metal wires surrounding the sheath.

12. The fuse of claim 11 wherein the strip is aluminum, and the wires are stainless steel.

13. A linear ignition fuse, comprising an elongated core of non-detonating ignitive material, a strip of metal foil wrapped helically about the core with edge portions of the strip in adjacent windings overlapping to form a solid sheath about the core, a longitudinally extending gas channel adjacent to the core for supporting an ignitive reaction which travels along the fuse, and a braided jacket of metal wires surrounding the sheath.

14. The fuse of claim 13 wherein the metal foil is aluminum.

* * * * *